US009756715B2

(12) United States Patent
Biallas et al.

(10) Patent No.: US 9,756,715 B2
(45) Date of Patent: Sep. 5, 2017

(54) FLANGE JOINT SYSTEM FOR SRF CAVITIES UTILIZING HIGH FORCE SPRING CLAMPS FOR LOW PARTICLE GENERATION

(71) Applicant: JEFFERSON SCIENCE ASSOCIATES, LLC, Newport News, VA (US)

(72) Inventors: George Herman Biallas, Yorktown, VA (US); Edward Daly, Yorktown, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 463 days.

(21) Appl. No.: 14/501,920

(22) Filed: Sep. 30, 2014

(65) Prior Publication Data

US 2015/0163895 A1 Jun. 11, 2015

Related U.S. Application Data

(60) Provisional application No. 61/914,651, filed on Dec. 11, 2013.

(51) Int. Cl.

| | |
|---|---|
| ***H05H 7/18*** | (2006.01) |
| ***H05H 7/22*** | (2006.01) |
| ***H05H 7/20*** | (2006.01) |

(52) U.S. Cl.

CPC ..... *H05H 7/18* (2013.01); *H05H 7/20* (2013.01); *H05H 7/22* (2013.01); *H05H 2007/225* (2013.01)

(58) Field of Classification Search

CPC ..... F16L 23/00; F16L 23/003; F16L 23/02; H05H 7/20; H05H 2007/225

USPC ..... 285/364, 406, 39, 45

See application file for complete search history.

(56) References Cited

U.S. PATENT DOCUMENTS

| | | | | |
|---|---|---|---|---|
| 2,451,941 A * | 10/1948 | Glover, Jr. | F16L 17/073 | 285/364 |
| 2,953,343 A * | 9/1960 | Heusner | E21D 15/589 | 285/364 |
| 3,091,487 A * | 5/1963 | Gallagher | F16B 2/245 | 285/406 |
| 3,372,949 A * | 3/1968 | McLay | F16L 49/04 | 285/364 |

(Continued)

FOREIGN PATENT DOCUMENTS

| | | | |
|---|---|---|---|
| JP | CA 2766382 A1 * | 2/2011 | B23K 26/206 |

*Primary Examiner* — David E Bochna

(57) ABSTRACT

A flange joint system for SRF cavities. The flange joint system includes a set of high force spring clamps that produce high force on the simple flanges of Superconducting Radio Frequency (SRF) cavities to squeeze conventional metallic seals. The system establishes the required vacuum and RF-tight seal with minimum particle contamination to the inside of the cavity assembly. The spring clamps are designed to stay within their elastic range while being forced open enough to mount over the flange pair. Upon release, the clamps have enough force to plastically deform metallic seal surfaces and continue to a new equilibrium sprung dimension where the flanges remain held against one another with enough preload such that normal handling will not break the seal.

11 Claims, 6 Drawing Sheets

(56) References Cited

U.S. PATENT DOCUMENTS

| | | | | | |
|---|---|---|---|---|---|
| 3,850,451 | A * | 11/1974 | Matthiessen | F16L 23/167 | 285/45 |
| 4,037,863 | A * | 7/1977 | Kunzle | B05B 15/065 | 285/364 |
| 4,058,328 | A * | 11/1977 | Nickerson | F16L 51/025 | 285/45 |
| 4,093,281 | A * | 6/1978 | Jansen, Jr. | E21B 17/085 | 285/39 |
| 4,223,922 | A * | 9/1980 | Pape | F16L 37/52 | 285/364 |
| 6,156,140 | A * | 12/2000 | Ayres | B29C 61/025 | 285/45 |
| 6,244,290 | B1 * | 6/2001 | Reicin | F16K 27/12 | 285/45 |
| 6,536,811 | B1 * | 3/2003 | Ranson, Jr. | F16L 23/04 | 285/364 |
| 6,997,483 | B2 * | 2/2006 | Perlatti | B60P 3/2265 | 285/45 |
| 8,674,630 | B1 * | 3/2014 | Cornelius | H05H 7/20 | 315/5.41 |
| 2016/0123518 | A1 * | 5/2016 | Stoltzfus | F16L 35/00 | 285/45 |

* cited by examiner

FLANGE JOINT SYSTEM FOR SRF CAVITIES UTILIZING HIGH FORCE SPRING CLAMPS FOR LOW PARTICLE GENERATION

This application claims the priority of Provisional U.S. patent application Ser. No. 61/914,651 filed Dec. 11, 2013.

The United States Government may have certain rights to this invention under Management and Operating Contract No. DE-AC05-06OR23177 from the Department of Energy.

FIELD OF THE INVENTION

The present invention relates to Superconducting Radio Frequency (SRF) cavities, and more particularly to a flange joint system for producing an RF-tight seal with minimum particle contamination to the inside of the cavities.

BACKGROUND OF THE INVENTION

The Continuous Electron Beam Accelerator Facility (CEBAF) at the Jefferson Lab in Newport News, Virginia, accelerates electrons through SRF cavities that are maintained at Ultra High Vacuum (UHV) or at less than $10^{-9}$ torr.

Deformable metal seals are typically used at the interface between the SRF cavities in order to form a vacuum-tight seal. The SRF cavities are typically joined together by installing and torqueing bolts or similar fasteners between flange joints on the ends of the cavities.

Unfortunately, in the act of assembling the cavities, the metal-to-metal contact between the threads of the bolt and the threads of the flange can produce microscopic contamination particles. If the dust particles are introduced into the SRF cavities, they can heat up and release electrons that interfere with the particles that are being accelerated by the accelerator, a problem called field emission.

Accordingly, it is essential for the proper operation of the accelerator to connect the SRF cavities in a manner that does not cause particulate generation. A reduction in particle generation results in a cleaner processing environment and a marked reduction in the number of cavities exhibiting field emission, which field emission can seriously degrade the performance of the particle accelerator.

OBJECT OF THE INVENTION

It is therefore an object of the present invention to provide a flange joint system for SRF cavities that will minimize generation of particulates that will negatively affect the performance of the particle accelerator.

SUMMARY OF THE INVENTION

According to the present invention there is provided a flange joint system for SRF cavities. The flange joint system includes a set of high force spring clamps that produce high force on the simple flanges of Superconducting Radio Frequency (SRF) cavities to squeeze conventional metallic seals. The system establishes the required vacuum and RF-tight seal with minimum particle contamination to the inside of the cavity assembly. The spring clamps are designed to stay within their elastic range while being forced open enough to mount over the flange pair. Upon release, the clamps have enough force to plastically deform metallic seal surfaces and continue to a new equilibrium sprung dimension where the flanges remain held against one another with enough preload such that normal handling will not break the seal.

DETAILED DESCRIPTION

Figure 1:
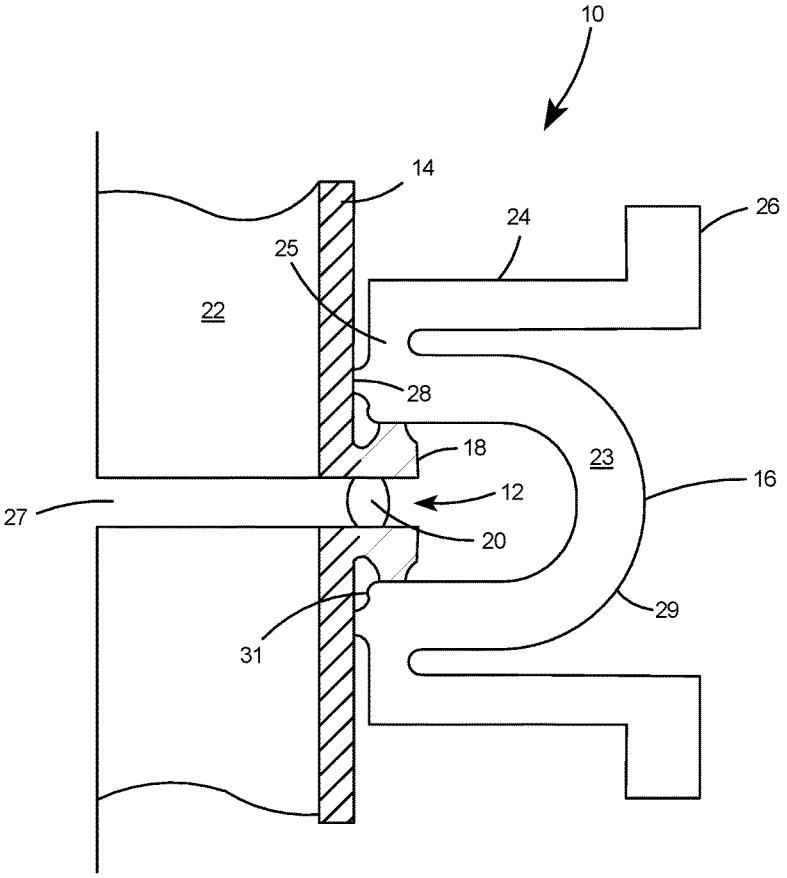
FIG. 1 is a side view of a flange joint system including spring clamp installed on the flange joint of an SRF cavity according to the present invention.

With reference to FIG. 1 there is shown a first embodiment flange joint system 10 installed on the flange joint 12 of an SRF cavity 14. The flange joint system 10 includes a set of spring clamps 16 that produce high force on the flanges 18 of Superconducting Radio Frequency (SRF) cavities to squeeze a conventional metallic seal 20. The system establishes the required vacuum and RF-tight seal with minimum particle contamination to the inside 22 of the cavity assembly. The spring clamps are designed to stay within their elastic range while being forced open enough to mount over the flange pair. Upon release, the clamps have enough force to plastically deform the surfaces of the metallic seal 20 and continue to a new equilibrium sprung dimension where the flanges remain held against one another with enough preload such that normal handling of the cavity assembly will not break the seal.

Preferably, the spring clamp 16 is constructed of a material having a high strength, low modulus of elasticity. A preferred material of construction of the spring clamp 16 is heat-treated 6Al4V Titanium. The advantage of using the spring clamp is to establish the flange joint 12 while generating fewer particles than conventional SRF cavity attachment methods. The conventional methods feature rubbing between surfaces in or near the flanges, such as screw threads or wedge clamps.

The exact shape and dimensions are determined by range of motion and required residual force. According to the first embodiment of the spring clamp shown in in FIG. 1, the clamp 16 includes a substantially "C" shaped clamp body 23 that is integral with or connected to arms 24 extending from the ends 31 of the body and the wings 26 extending from the arms. The arms 24 and wings 26 cause added moment to be applied throughout the body 23 of the "C" shaped clamp 16 while it remains within the elastic limit. This allows a larger differential gap opening 27 than without the arms and wings. The spring clamp 16 includes at least one registration contact 28. The clamp body 23 includes an arcuate outer surface 29, two ends 31, and a base 25 extending from each end of said clamp body.

Figure 2:
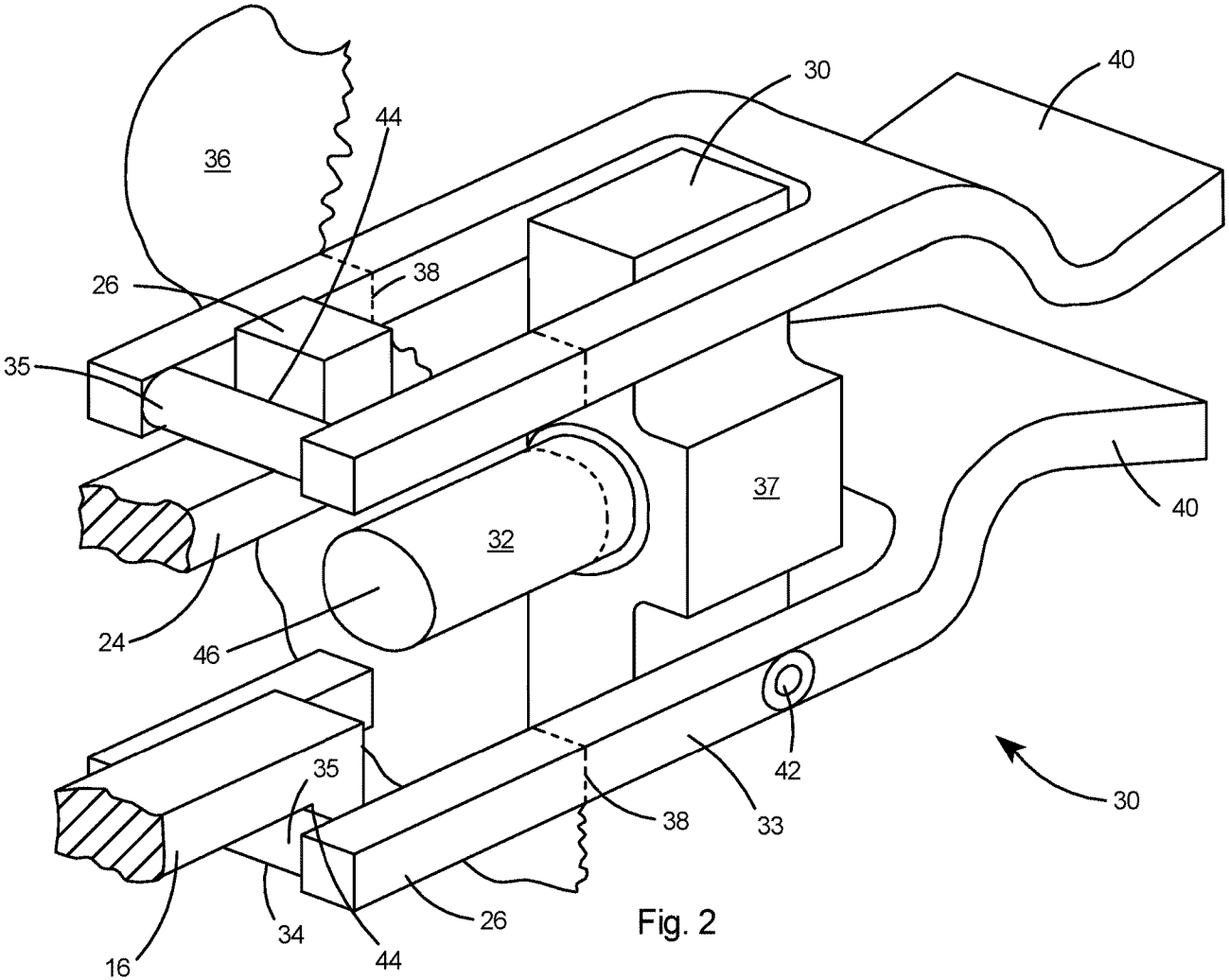
FIG. 2 is an isometric view of the flange joint system of FIG. 1 including the opening device for the spring clamp.

Referring to FIG. 2, the spring clamp 16 is preferably opened using an opening device 30 featuring a hydraulic piston 32, stirrup arms 33, and stirrups 34. The stirrups 34 include rolling contact surfaces 35 that are rotatable with respect to the wings 26 of the spring clamp 16. The main working elements of the flange joint system 10 are preferably isolated from the clean room environment using an enclosure bag 36, of which a broken away portion is shown in FIG. 2. The enclosure bag 36 seals completely around the stirrup arms 33, the hydraulic piston 32, and the piston actuator 37, as shown by seal lines 38 in FIG. 2. The opening device 30 includes two tongs 40 which function to release the stirrups 34 after setting the clamp in place onto the flange joint. The stirrup arms 33 each include a bearing 42 therein. The stirrup bearings 42 are preferably enclosed within the enclosure bag 36 so that particles generated with the bearings will be trapped within the bag. Most preferably, the enclosure bag 36 is constructed of flexible nylon material.

Figure 3:
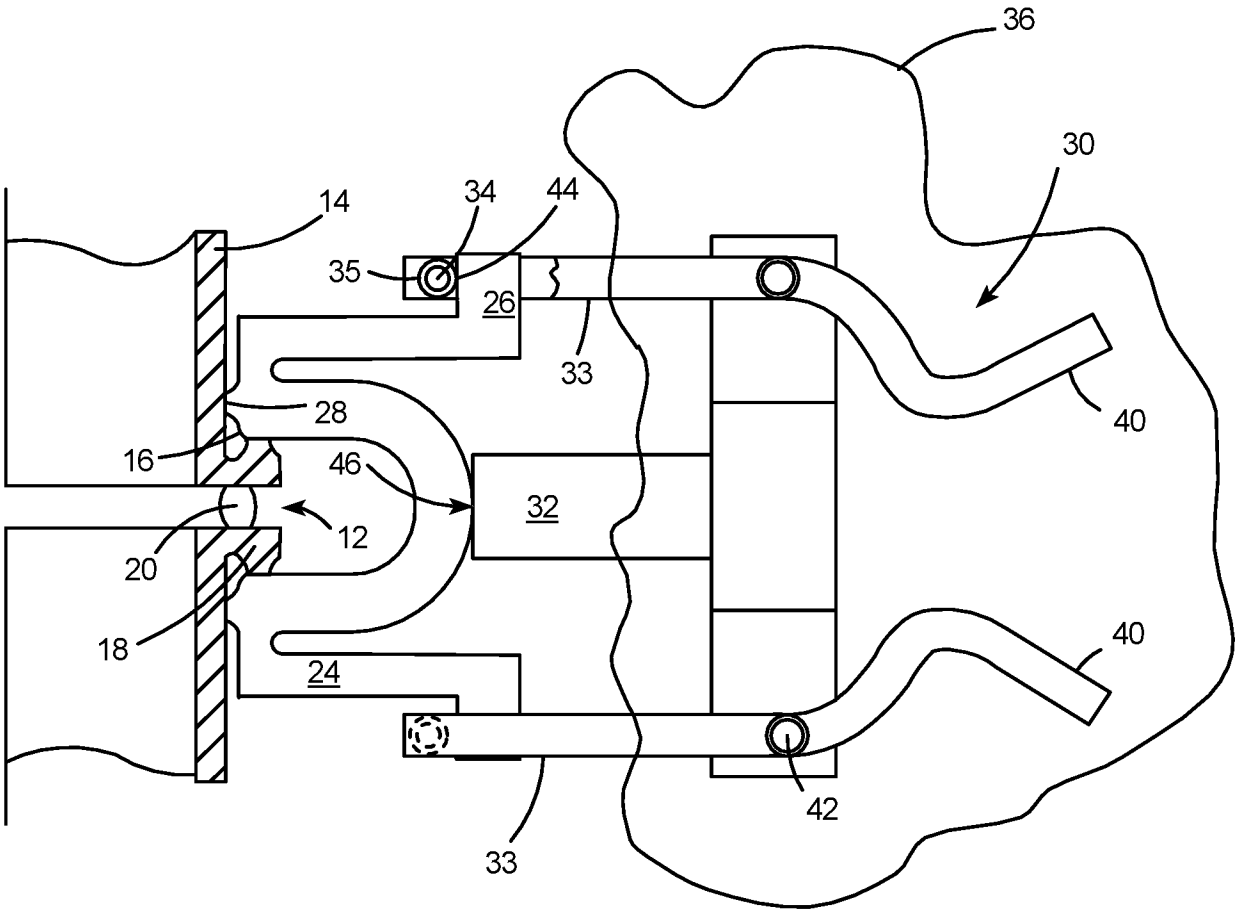
FIG. 3 is a side view of the spring clamp and opening device of the flange joint system.

With reference to FIG. 3, the contact of the spring clamp 16 to the opening device 30 is preferably at three points, including outer contacts 44 at each of the rolling contact surfaces 35 and a central contact 46. The central contact 46 utilizes only simple compression during activation. The outer two contacts 44 compress against the wings 26 of the clamp's arms 24. The tension and moment in the arms 24 opens the clamp 16. These compression joints between stirrups 34 and wings 26 experience only rolling motion during opening and releasing the clamp 16, thereby minimizing creation of particulates from friction between the two elements. When placed in use on a flange joint, the spring clamps 16 are preferably applied and released at the same time as paired sets on opposing sides of mated flanges. This simultaneous clamping avoids any tipping of the flanges about the metallic seal 20 as when only one clamp is applied.

Several sets of opening devices 30 may be loaded with spring clamps 16 and opened, ready to fit over the flanges 18, prior to SRF cavity assembly. The fully opened sets can be washed down and determined to be particle free using particle free air blasts and particle counters as part of entry into the clean room.

The flange joint system provides an apparatus for the assembly of SRF cavities in a manner that minimizes particulate generation or particular infiltration of the assembled cavities. The cavity assembly process includes loading the cavities in fixtures and applying the metallic seals and additional parts and closing them up in a manner that generates minimal particles.

Figure 4:
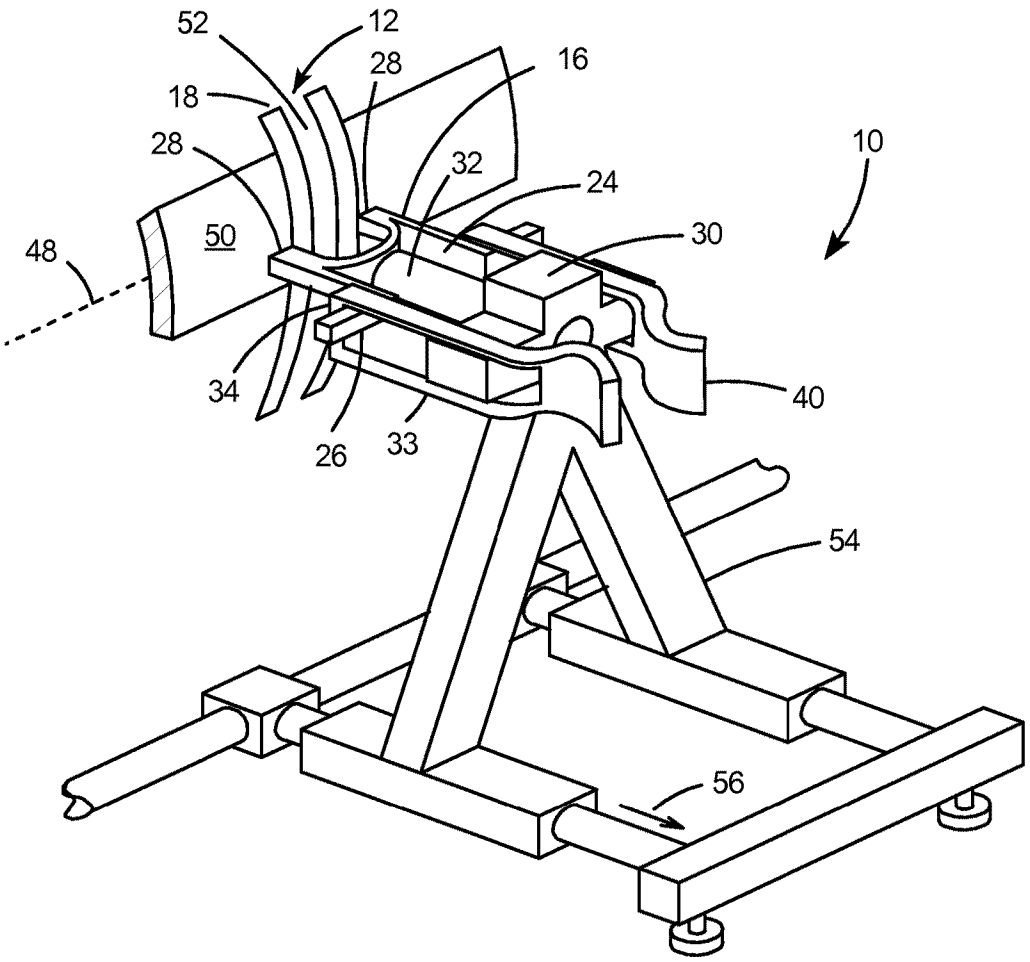
FIG. 4 is an isometric view of the flange joint system and associated tooling for one side of the clamp assembly.

With reference to FIG. 4, there is depicted the constraint tooling 54 for one side of the spring clamp assembly for SRF cavities. In the embodiment depicted in FIG. 4, the cavity axis 48 is oriented horizontally. The first set of spring clamps 16 are applied from each side, registering for limit of travel against a cavity neck surface 50. The clean room air downwash caries away any resulting particles from the contact. The hydraulic pressure of the hydraulic piston 32 in the paired opening devices 30 in clamps 16 is slowly released bringing the registration contacts 28 of one clamp in contact with the cavity neck surface 50.

Preferably, the pairs of pistons 32 in the opposing clamps are connected to hydraulic fluid in parallel, thereby making at least one registration contact 28 of a first clamp 16 engage the cavity neck surface 50 before any substantial force is generated at the second clamp (not shown). Preferably, downwash carries away any loose particles from the engagement of registration contacts 28 to flange 18 as the seal is established. More importantly, the flange joint 12 is out of the path of any downwashed particles. Further release to zero hydraulic pressure allows the clamps to further deform the metallic seal 20 (see FIG. 1) between the flanges. The remaining sprung gap 52 in the clamps provides the force that maintains the metallic seal.

It is critical at this point that positive contact and constant orientation be maintained between the two outer stirrups 34 of the opening device 30 and the wings 26 on the clamp arms 24 to insure that no rubbing ensues. As shown in FIG. 4, this disciplined contact is accomplished using constraint tooling 54 upon which the opening devices 30 are mounted. The pistons 32 of the opening devices 30 may be fully backed off without causing rubbing between the clamp 16 and flanges 18. A small radial inward movement of the constraint tooling releases contact of the stirrups 34 of the opening device from the wings 26 without rubbing. Following this, the stirrups 34 can be opened, by hand pressing the tongs 40 through the bags 36 (see FIG. 3), to be clear of the wings 26 of the clamp 16. The constraint tooling 54 with opening devices 30 are then pulled radially outward to be clear of the flanges 18. All clamp 16 to opening device 30 contact surfaces are outside the region of the gap 52 between flanges 18 to minimize the likelihood of particle contamination. Any particles generated by operating of the clamps 16 and the opening devices 30 are likely caught in the downwash. Note that the bearings 42 (see FIG. 3) for the stirrups 34 are within the bag enclosure 36 so that particles generated therein are trapped in the bag.

After a first pair of spring clamps 16 are secured to the flanges 18, the cavity assembly may be rotated about its axis by one clamp increment angle using the constraint tooling 54. Additional sets of paired opening devices 30 and clamps 16 are then mounted to the constraint tooling 54 and the clamps applied in the same manor to the newly exposed flange positions until preferably all angular positions are filled.

Because of the limited range of motion of the spring clamp 16, the system relies on exacting tolerances of the thicknesses of flanges 18 and metallic seals 20 and the dimension of the un-sprung gap 52 in the jaw of the spring clamp. At the time of assembly, the actual stack-up of flanges 18 and associated seals 20 may be assessed, preferably by non-contact optical means, and clamps with the appropriate gaps are preferably selected from a plurality of pre-constructed clamps. Preferably, the spring clamps 16 are cut to shape from pre-heat-treated flat stock using water jets and subsequently machined only on the contact surfaces.

Figure 5:
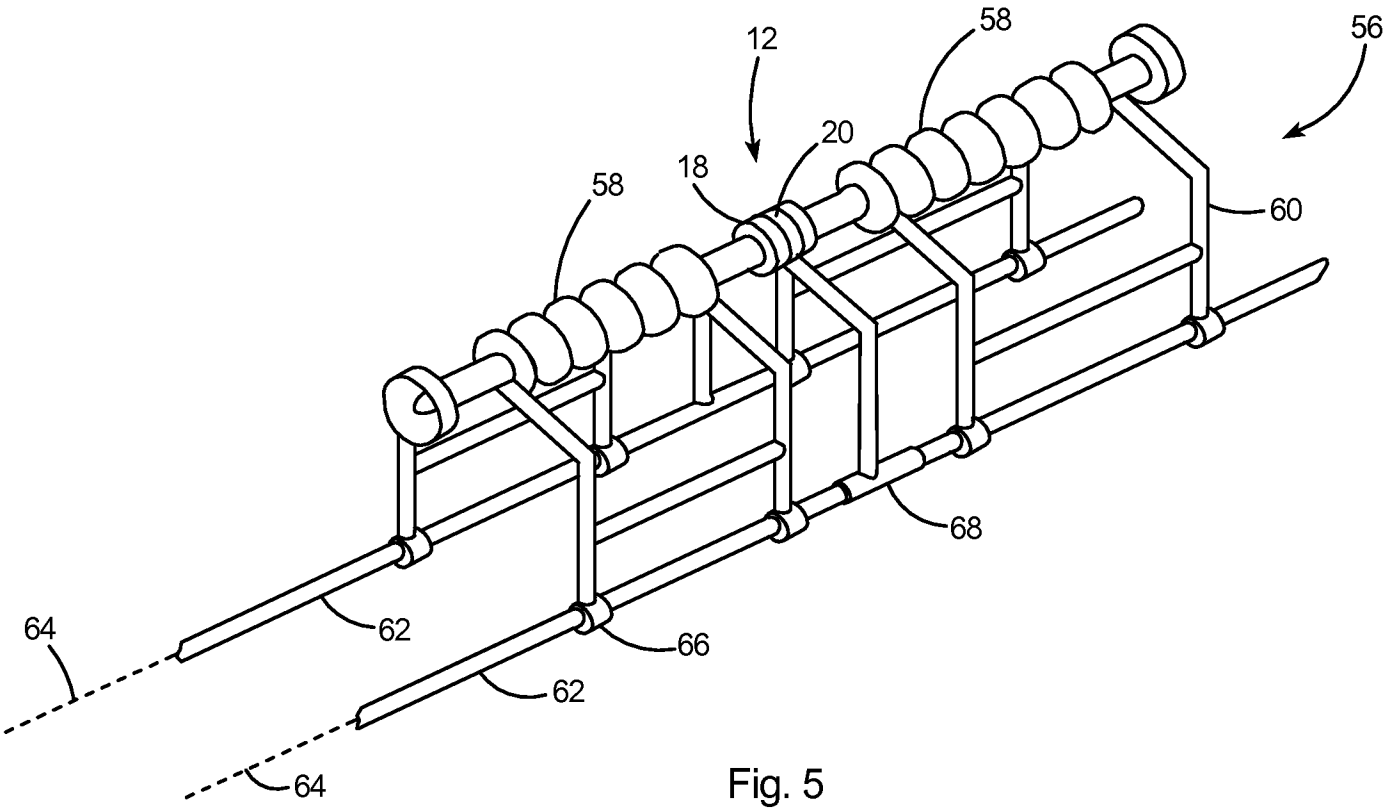
FIG. 5 is an isometric view of an alternative embodiment of cavity assembly tooling for the flange joint system of the present invention.
Figure 6:
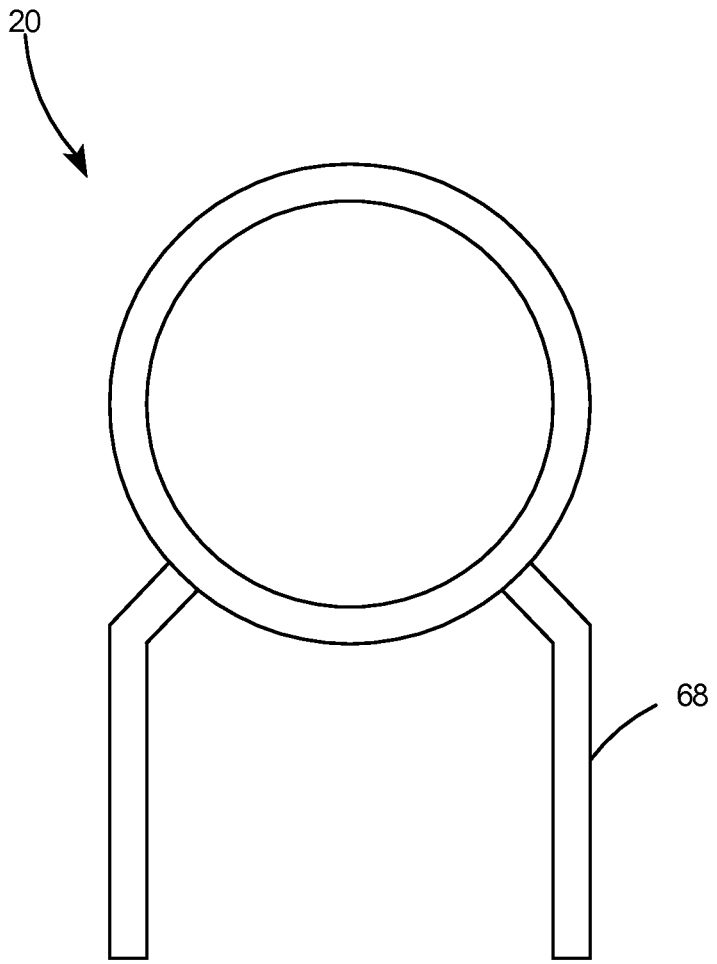
FIG. 6 is an isometric view of the cavity assembly tooling for the flange joint system of the present invention.

Referring to FIG. 5, an alternative embodiment of cavity assembly tooling 56 for a flange joint system according to the present invention includes SRF cavities 58 mounted on cavity mounting carts 60 mounted to a set of parallel rails 62 along horizontal axes 64. The cavity mounting carts 60 are connected to the rails 62 by sealed roller bearings 66 to enable the carts to roll along the rails 62. The cavity mounting carts 60, roller bearings 66, and rails 62 are preferably purged by downwash. A seal cart 68 is preferably provided at the flange joint 12 to support the metallic seal. As shown in FIG. 6, the metallic seal 20 preferably includes a pair of radially outward prongs 68 facing down that allow mounting to a seal cart 68 (see FIG. 5) between the cavity mounting carts 60.

Referring to FIG. 5, the cavity assembly tooling 56 enables adjacent SRF cavities 58 to be joined together with no rubbing between flanges 18 and metallic seal 20 thereby minimizing particle generation. The metal seal's prongs 68 (see FIG. 6) preferably remain in place during the assembly of the SRF cavities and connection of the clamps. Preferably, there is no step in the flanges 18 upon which the metal seal 20 can be registered. Preferably, a step and seal registration method is not used in order to avoid rubbing of the seal during placement within the flange joint 12 and a resulting generation of particles within the flange joint. Preferably, the cavity assembly tooling and constraint tooling may be washed down and determined to be particle free before assembly begins.

Alternatively, another embodiment of the cavity assembly tooling may include the cavities mounted vertically on a vertical rail system (not shown). The clean room's air motion direction is correspondingly changed to minimize particles alighting into the cavity assembly.

What is claimed is:

1. A flange joint system comprising:

a spring clamp including a clamp body, arms extending from said body, and wings extending from said arms;

an opening device including a hydraulic piston and two pairs of stirrup arms pivotable around said hydraulic piston;

a bag forming an enclosure for particulates said bag sealing around said hydraulic piston and said stirrup arms;

a stirrup extending between each of said stirrup arms of said opening device; and a rolling contact surface on each of said stirrups of said opening device.

2. The flange joint system of claim 1 including a stirrup arm bearing connecting said stirrup arms to said hydraulic piston of said opening device.

3. The flange joint system of claim 1, wherein said clamp body includes an arcuate outer surface.

4. The flange joint system of claim 1 including a registration contact extending from said spring clamp.

5. The flange joint system of claim 1 including a tong connecting each of said pairs of stirrup arms.

6. The flange joint system of claim 1, wherein said clamp body is substantially C-shaped and said wings are substantially perpendicular to said arms of said spring clamp.

7. The flange joint system of claim 1 including a piston actuator on said opening device.

8. The flange joint system of claim 1 including constraint tooling connected to said opening device.

9. The flange joint system of claim 1 including cavity assembly tooling connected to said opening device.

10. A flange joint system comprising:

a spring clamp including a clamp body, arms extending from said body, and wings extending from said arms;

an opening device including a hydraulic piston and two pairs of stirrup arms pivotable around said hydraulic piston;

a bag forming an enclosure for particulates said bag sealing around said hydraulic piston and said stirrup arms; and said clamp body includes two ends, a base extending from each end of said ends of said clamp body, and said arms extending from said base.

11. A flange joint system comprising:

a spring clamp including a clamp body, arms extending from said body, and wings extending from said arms;

an opening device including a hydraulic piston and two pairs of stirrup arms pivotable around said hydraulic piston;

a bag forming an enclosure for particulates said bag sealing around said hydraulic piston and said stirrup arms; and a rolling contact surface on each of said stirrups of said opening device, wherein contact of said spring clamp to said opening device includes outer contacts on said rolling contact surfaces on said opening device and a central contact on said opening device.

* * * * *